United States Patent [19]

Zakrzewski et al.

[11] 4,058,941

[45] Nov. 22, 1977

[54] BUILDING CONSTRUCTION

[75] Inventors: Andrew Steven Zakrzewski, Burlington; Douglas Mel Clarkson, Brantford; Gordon A. Webster, Dundas, all of Canada

[73] Assignee: Dominion Foundries and Steel, Limited, Hamilton, Canada

[21] Appl. No.: 693,853

[22] Filed: June 8, 1976

[51] Int. Cl.[2] ..... E04H 1/02

[52] U.S. Cl. ..... 52/169.1; 52/261; 52/262; 52/274; 52/293

[58] Field of Search ..... 52/169, 274, 293, 169.1, 52/261, 262

[56] References Cited

U.S. PATENT DOCUMENTS

| | | | |
|---|---|---|---|
| 1,815,492 | 7/1931 | Bradley | 52/293 X |
| 1,955,818 | 4/1934 | Marshall | 52/274 X |
| 3,036,347 | 5/1962 | Findleton | 52/702 |
| 3,771,273 | 11/1973 | Brodie | 52/93 X |

*Primary Examiner*—Alfred C. Perham
*Attorney, Agent, or Firm*—Hirons & Rogers

[57] ABSTRACT

A new building construction is intended especially but not exclusively for use in areas with "active soils", i.e., soils in which drastic dimensional changes occur with the seasons, owing principally to changes in water content. Such soils heave considerably particularly, within the confines of the building footing, causing severe cracking of any floor laid directly thereon and possibly of the floors above. In this new construction the lowermost floor structure is supported by one or more trusses, each of which is supported at its ends on the footing. The ends of the truss or trusses slide freely on the footings so as not to be affected by movement of the latter and are therefore clear of any direct earth movements.

The truss or trusses support vertical loads only, while the floating floor structure is arranged to withstand the horizontal forces applied by the active soil. Any other floor structure is supported from the lowermost floor structure by means of one or more post members supported directly by the truss or trusses and in turn supporting respective beams for the other floor structure. In this way none of the floor structures of the building is adversely affected by the soil movements.

12 Claims, 7 Drawing Figures

BUILDING CONSTRUCTION

FIELD OF THE INVENTION

The present invention is concerned with improvements in or relating to building construction and especially, but not exclusively to building construction intended for use in areas of "active soil".

REVIEW OF THE PRIOR ART

Special difficulty is encountered with building construction in areas with "active soil", that is to say areas in which changes of season cause relatively large dimensional changes and movements in the soil on which the building is located, due principally to the large changes in the soil moisture content that accompany such seasonal changes. Other factors may however also be significant in the changes that are observed in practice. Conventional constructions for buildings employ a perimeter footing. Even if strongly-reinforced footings are employed, which of course are expensive to build, the soil confined within the footing will change and heave or subside vertically to a much larger extent than the footing itself. It is not unknown for example in such cases for vertical movements of 6 or up to 8 inches (15–20 cm.) to take place, causing severe cracking of any floor laid thereon, and resulting in constant, severe problems of repair and maintenance.

The problems caused by such heaving and subsiding are not confined to the lowermost floor laid directly on the soil since, in all but the smallest houses, it is standard practice to provide one or more load-bearing walls and/or posts supported by the lowermost floor and in turn supporting the floors above. Any severe movement of these walls and/or posts will be transmitted directly to the floors above with a high possibility of damage thereto.

One construction employed hitherto to avoid this problem has been to build the footing on concrete piles extending typically 15–25 feet (5–8 meters) into the soil, but this is again an expensive solution.

DEFINITION OF THE INVENTION

It is therefore an object of the invention to provide a new building construction especially suitable for use in areas of "active soil".

In accordance with the present invention there is provided a building construction consisting of:

a footing on the soil delineating the building perimeter;

vertically-extending building walls mounted on the footing;

a main support member extending between and supported at its ends by opposite portions of the footing, with the said ends slidable freely lengthwise of the support member upon the said footing portions; and a lowermost floor structure supported by the said main support member, the lowermost floor structure extending between and engaging the said building walls to oppose horizontal forces applied thereto by movements of the soil.

Preferably, the said main support member is a truss.

Preferably, means for supporting another floor construction above the said lowermost construction includes at least one post member extending vertically from the said main support member and in turn supporting a floor support member for the said another floor construction.

DESCRIPTION OF THE DRAWINGS

House constructions which are particular preferred embodiments of the invention will now be described, by way of example, with reference to the accompanying drawings, wherein.

DESCRIPTION OF THE PREFERRED EMBODIMENTS

Figure 3:
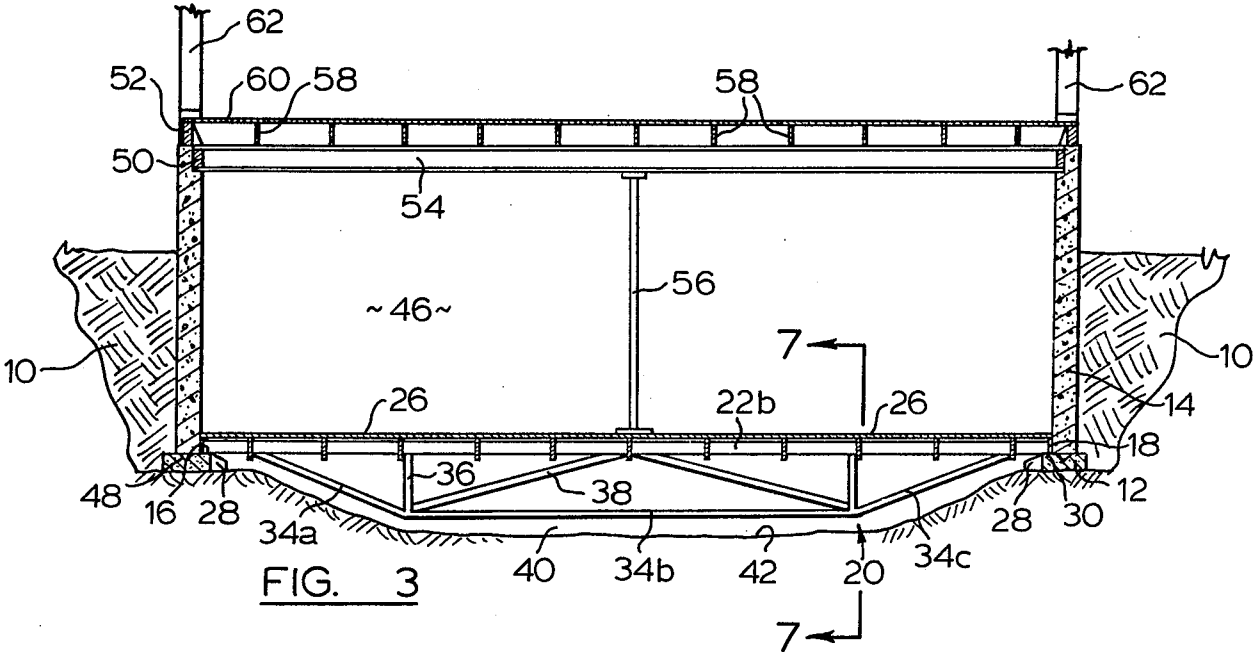
FIG. 3 is a section in elevation taken on the line 3—3 of FIG. 1.

The soil on and in which the house is built is indicated generally by the reference 10 (FIG. 3). Although the constructions to be described are especially intended for use in areas of "active soil" they have advantages over conventional constructions that can justify their general use. In the constructions particularly described the soil is excavated and the house includes a partially below ground basement, but the invention is also applicable to constructions which have no basement, or in which the basement is entirely below ground (e.g. in small commercial buildings). The soil normally is excavated to below the frost line level (see FIG. 3) and a conventional rectangular cross-section footing 12 is then formed on the soil around the entire perimeter of the house. If desired the footing may be reinforced with longitudinal steel rods (not shown). Basement side walls 14 are then mounted on the footing and can, for example, be of steel, or wood, or cement block, or (as illustrated) pre-cast concrete. The footing is wider than the wall to provide a horizontal inner ledge 16 receiving and supporting a perimeter header 18 that extends around the entire footing. The footing supports a floor structure constituted by the perimeter header 18, one or more trusses 20, joists **22*a* and 22*b*, parallel blocking members 24, and sheathing panels 26**, as will be described in more detail below.

Figure 1:
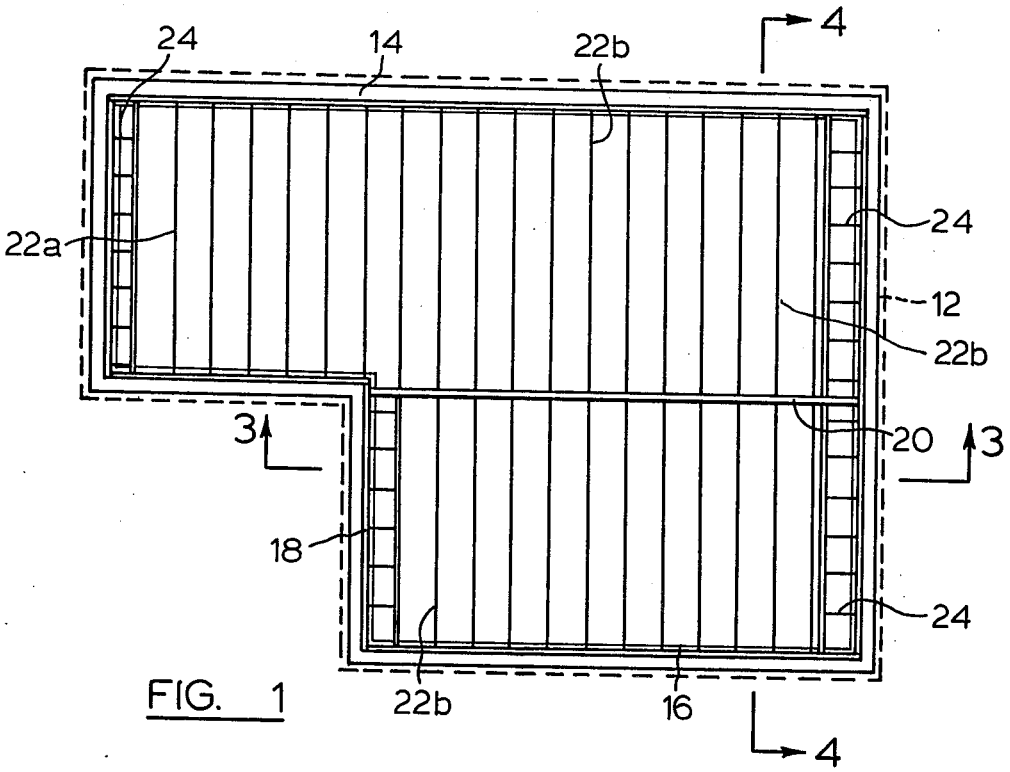
FIG. 1 is a horizontal section through a typical L-shape house to show the joist arrangement of the lowermost floor, a single truss being employed therein.
Figure 2:
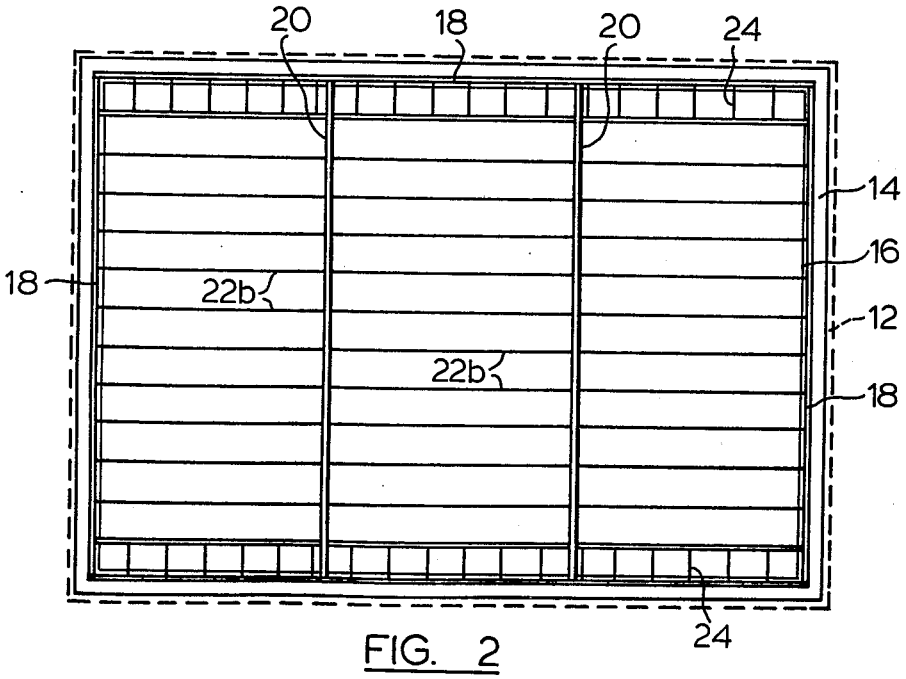
FIG. 2 is a similar section through a typical rectangular shape house, two parallel trusses being employed therein.
Figure 5:
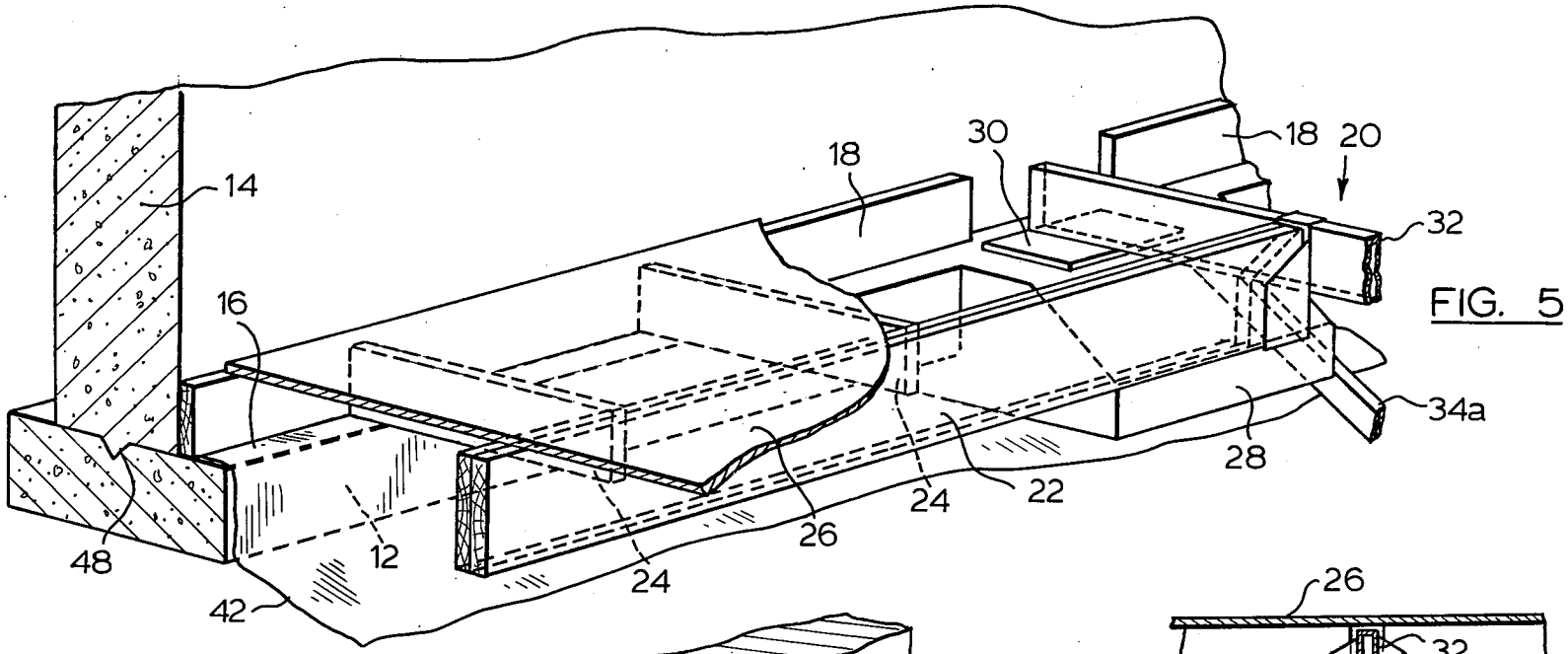
FIG. 5 is a partial perspective view drawn to a larger scale to show greater detail of construction, parts being shown broken away as necessary for clarity of illustration.
Figure 7:
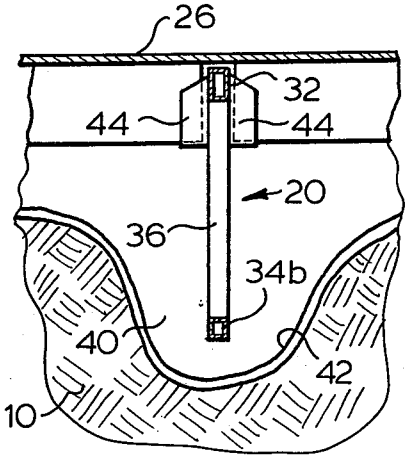
FIG. 7 is a section taken on the line 7—7 of FIG. 1.
Figure 6:
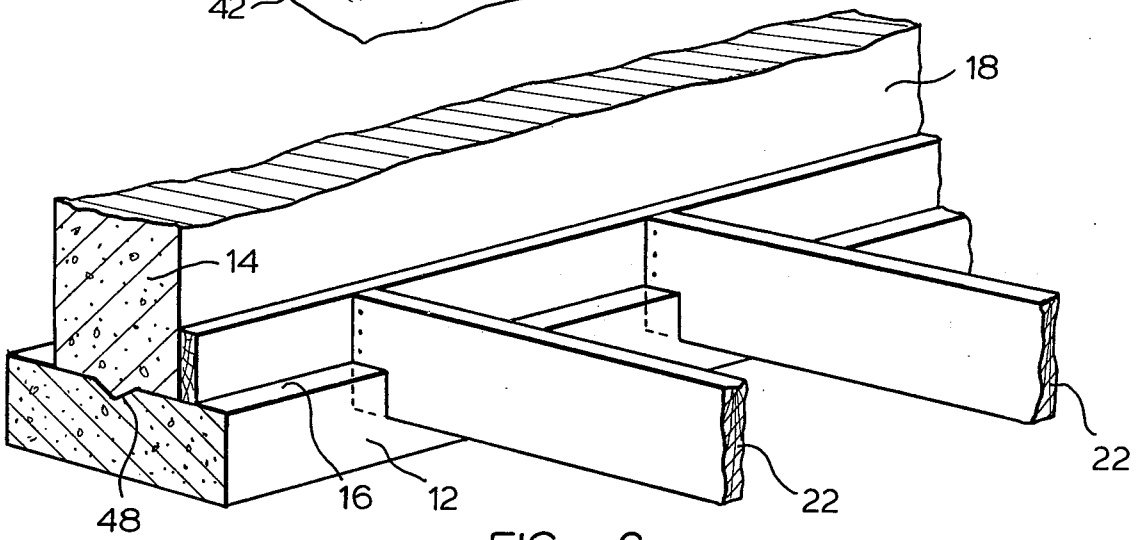
FIG. 6 is a view similar to FIG. 5 taken at right angles thereto.

The maximum economical single span for ordinary wooden floor joists is about 16–18 feet (5–6.5 meters) and in any part of the construction in which the joists 22 are of this length or less, for example the joists **22*a* (FIG. 1), they will rest at each end on the respective opposite portions of the footing ledge 16. The span for the remaining joists 22*b* is much longer than 16–18 feet, and accordingly, in the construction of FIG. 1 a single main support member 20 is provided to permit joists of shorter lengths to be used, or to permit continuous joists to be supported appropriately intermediate their ends. In the construction of FIG. 2 two parallel main support members are employed. Each main support member is in these embodiments a steel truss extending perpendicularly to the joists 22*b* and resting at its ends on a special inward extension 28 (FIGS. 3 and 5) of the footing ledge 16. A bearing plate 30 is provided between each truss end and the footing extension 28, to distribute the load of the truss ends and to permit easy sliding of the ends on the footing without excessive wear as the footing moves as a result of the varying soil conditions. The perimeter heading 18** has gaps adjacent the joist ends to accommodate the anticipated movement of the footing.

Figure 4:
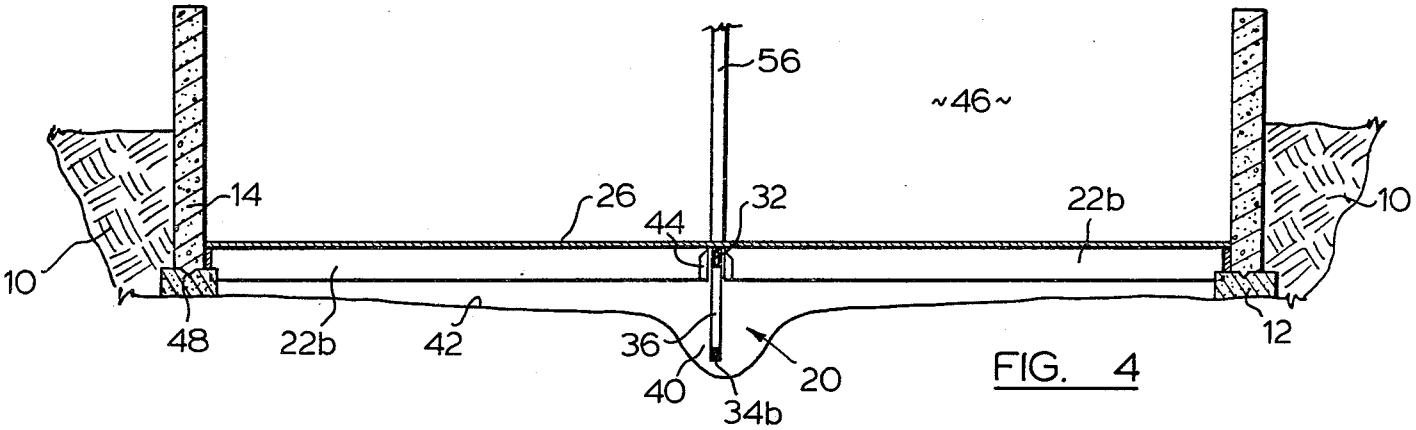
FIG. 4 is a section in elevation at right angles to that of FIG. 3, taken on the line 4—4 of FIG. 1.

The truss 20 in this embodiment comprises upper run member 32, members 34*a*, 34*b* and 34*c* together constituting the lower run of the truss, vertical members 36 and inclined members 38. The depth of the truss and the dimensions of its members are determined using well-established principles, and are dependent upon the load to be supported and the stiffness required. The truss extends below the footing on which it rests and underlying soil in the immediate neighbourhood 40 of the truss is excavated in accordance with the local building code to give the necessary clearance. Thus, under some codes it may be necessary for the entire area of the basement to be excavated to the depth necessary to accommodate the truss, but others may permit a trench parallel to the length of the truss. If there are no storm or sanitary sewers, or if those provided are not deep enough, then the lowermost portion of the excavation or trough will be provided with a sump (not illustrated) and means for drawing water therefrom. The required vapour barrier may be constituted by a layer 42 (FIG. 4) of suitable plastic material, e.g. polyethylene, laid on the soil and led up between the bottom portion of the wall and the perimeter header 18. The ends of the joists 22*b* resting on the footing are disposed in preformed pockets therein and butt tightly at their ends against the footing. The joists nearest to the perimeter header are doubled (see FIG. 5) and are connected to the header by the parallel blocking members 24.

The ends of the joists 22*b* butting the upper run truss member 32 are supported therefrom by saddle-shaped metal hangers 44, which may be simply hung on to the truss and then located lengthwise thereof as the joist ends are inserted therein. Since a joist end is received on either side there is only downward force on the hanger. The sheating panels 26 laid over the joists 22 typically may be constituted by sheets of plywood of $\frac{5}{8}$ – $\frac{3}{4}$ inch thickness (1.58 – 1.9 cm.). The adequate fastening of the sheets to the perimeter header 18, the joists 22*a* and 22*b*, and the blocking members 24, e.g. by means of nails or screws and/or glue, is very important in order to join them together into a single composite structure. Thus, the sheathing panels hold the perimeter header and the joists against sideways deflection under the endwise forces which are applied to them by the footing as it is moved by the "active soil", while the joists prevent buckling of the panels under these same forces. The perimeter headers 18 parallel to the joists, the adjacent joists 22 and the respective blocking members 24 cooperate with the panels to form horizontal girders which transmit the forces applied by the footing into the sheathing panels. The elements of the floor structure therefore cooperate with one another to provide the desired composite action in all directions resisting the horizontal forces applied to the footing, but resting on the footing so that it is not adversely affected by vertical movements thereof, or of the soil within the footing.

As explained above these embodiments involve substantial excavation into the soil, and what is in effect a basement room 46 (FIG. 3) is formed by the basement side walls 14. The bottom edge of each cast wall has a key 48 fitting into a corresponding longitudinal slot in the footing. The top edges of the walls are recessed to provide respective pockets 50 and are provided with a perimeter band joist 52. An upper floor centre beam 54, preferably a steel beam, is now mounted directly vertically above the truss 20, this beam 54 being supported at its ends by the walls 14 inserted in the pockets 50 and intermediate its ends by at least one vertical post 56 having its lower end positioned directly over the truss; it will be noted that in this preferred embodiment its foot is directly above the butting ends of the inclined truss members 38. In this embodiment only a single post is illustrated, and this is preferred to provide the minimum obstruction in the room 46, but in other arrangements it may be preferred to use more than one post spaced from one another, or a load bearing wall, or a combination of post and wall. In this embodiment the truss 20 and the centre beam 54 are parallel to one another, but this is not necessarily the case.

Joists 58 are now mounted on the walls 14 with their outer ends resting on the upper edges thereof and their inner ends supported by the centre beam 54 to provide a flush upper surface to which a sub floor 60 is securely fastened, formed for example of plywood sheets. Another wall 62 of any conventional type may now be mounted on the floor thus formed. If a third floor is to be provided above the second floor, then the joists for that third floor will be supported from the centre beam 54 by a vertical post and/or wall functioning similarly to the post or wall 56.

Another advantage of a suspended floor system as particularly described is the ability to run heating ducts and other services beneath the floor of the room 46, and this is not possible in the conventional construction in which a cement floor is formed directly on the excavated soil, especially in view of the high possibility of breakage with floor heaving.

We claim:

1. A building construction consisting of:

a footing on the soil delineating the building perimeter;

vertically-extending building walls mounted on the footing;

a main support member extending between and supported at its ends by opposite portions of the footing with the said ends slidable freely lengthwise of the support member upon the said footing portions; and a lowermost floor structure supported by the said main support member, the lowermost floor structure extending between and engaging the said building walls to oppose horizontal forces applied thereto by movements of the soil.

2. A building construction as claimed in claim 1, wherein the said main support member is a truss member.

3. A building construction as claimed in claim 2, wherein the truss member extends below the footing on which it rests.

4. A building construction as claimed in claim 1, and including another floor structure supported from the said main support member by means including at least one vertically-extending post interposed between the main support member and a centre beam for the another floor structure.

5. A building construction as claimed in claim 1, and including another floor structure supported from the said main support member by means including a vertically-extending load-bearing wall interposed between the main support member and a centre beam for the another floor structure.

6. A building construction as claimed in claim 1, wherein the ends of the main support member rest on horizontal ledges provided by respective footing extensions on the inner sides of the footing.

7. A building construction as claimed in claim 1, wherein the ends of the main support member rest on bearing pads on the footing permitting free longitudinal sliding of the said ends.

8. A building construction as claimed in claim 6, wherein the ends of the main support member rest on bearing pads on the said footing extensions permitting free longitudinal sliding of the said ends.

9. A building construction as claimed in claim 4, wherein the said main support member and the centre beam for the upper floor structure are parallel to one another.

10. A building construction as claimed in claim 4, wherein the said vertically-extending building walls are basement walls, and there is provided another wall construction above and supported by the said basement building walls, a further floor structure centre beam extending between two opposite walls of the said another wall construction, a further floor structure supported by the said another wall construction and the said further floor structure centre beam, and at least one other vertically-extending load-bearing member, each said other load-bearing member being interposed between the said other floor structure centre beam and the further floor structure centre beam intermediate their ends to support the latter from the former.

11. A building construction as claimed in claim 10, wherein the said further and another floor structure centre beams are parallel to one another.

12. A building structure as claimed in claim 1, wherein means for supporting joists from the said main support member comprise saddle-shaped hangers mounted on the said member to straddle it, the hanger providing on each side of the member a pocket for the reception of the adjacent joist end, the hangers being slidable lengthwise of the member.

* * * * *